US008381550B1

(12) United States Patent
Lin et al.

(10) Patent No.: US 8,381,550 B1
(45) Date of Patent: Feb. 26, 2013

(54) NEEDLE BED STRUCTURE FOR FLAT KNITTING MACHINES

(75) Inventors: Yu-Sheng Lin, New Taipei (TW); Yi Chen Chen, New Taipei (TW); Kai Ying Cheng, New Taipei (TW); Jian-Hao Peng, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 22 days.

(21) Appl. No.: 13/236,313

(22) Filed: Sep. 19, 2011

(51) Int. Cl.
*D04B 15/36* (2006.01)

(52) U.S. Cl. ..... 66/64

(58) Field of Classification Search ..... 66/64, 75.1, 66/75.2, 114, 115
See application file for complete search history.

(56) References Cited

U.S. PATENT DOCUMENTS

| | | | | |
|---|---|---|---|---|
| 3,735,812 | A * | 5/1973 | Flavell et al. | 66/104 |
| 4,713,948 | A * | 12/1987 | Schmidt et al. | 66/106 |
| 5,475,990 | A | 12/1995 | Schmid et al. | |
| 6,240,749 | B1 * | 6/2001 | Stoll et al. | 66/60 R |

FOREIGN PATENT DOCUMENTS

| | | | |
|---|---|---|---|
| DE | 3917934 | A1 * | 12/1989 |
| EP | 1522617 | A1 | 4/2005 |
| EP | 1522618 | A1 | 4/2005 |

* cited by examiner

*Primary Examiner* — Danny Worrell
(74) *Attorney, Agent, or Firm* — Muncy, Geissler, Olds & Lowe, PLLC

(57) ABSTRACT

A needle bed structure for flat knitting machines that is located at two sides of a needle bed gap includes a plurality of parallel needle plates, a plurality of knitting needles and sinkers located between the needle plates, a sinker control portion movable in parallel with the arranged direction of the sinkers, and at least one control cam driven by a switching portion to push the sinkers to rotate towards the needle bed gap during the switching movement. The switching portion performs a switching movement according to the moving direction. The needle plates hole at least one needle pressing board to restrict vertical movement of the knitting needles. The switching portion has a magnetic attracting portion corresponding to the needle pressing board to form magnetic attraction therewith. A spacer is provided between the needle plates to prevent the horizontal movement of the sinkers.

15 Claims, 7 Drawing Sheets

NEEDLE BED STRUCTURE FOR FLAT KNITTING MACHINES

FIELD OF THE INVENTION

The present invention relates to a flat knitting machine and particularly to a needle bed structure for flat knitting machines.

BACKGROUND OF THE INVENTION

In a conventional flat knitting machine a sinker between knitting needles is employed to control a yarn threaded through a knitting needle in loop releasing, loop coupling, loop escaping and loop forming processes. The sinker has a protrusive edge at one side corresponding to the knitting needle. When the sinker is rotated the protrusive edge presses the yarn picked up by the knitting needle to form a loop, thereby to form a pattern on the surface of the knitting fabric.

In order to stabilize rotation of the sinker, a sinker bed usually is provided on the needle bed. For instance, European patent EP1522618 and EP1522617 disclose a sinker bed mounted onto a needle bed via a coupling seat. The sinker bed has a trough corresponding to each sinker to restrict movements of the sinker without skewing. In addition, the sinker bed has a control portion to control rotation of the sinker, such as that disclosed in U.S. Pat. No. 5,475,990. In general, the sinker control portion includes a first cam and a second cam positioned next to each other. The first cam and second cam are braced by a linked movement mechanism on a base on which the sinker bed is movable horizontally. The linked movement mechanism has at least one magnet to form magnetic attraction with the sinker bed. When the sinker control portion moves horizontally relative to the sinker bed, the horizontal direction of movement determines whether the first cam and second cam will push the sinker on the first cam and second cam, then change the rotation angle to form a yarn loop at a different size.

In practice, whether the sinker control portion can move steadily and horizontally relative to the sinker bed determines whether the sinker can accurately perform the rotation movement. If the surface of the sinker bed is rough, unsmooth movement of the sinker control portion could be happen, and rotation control of the sinker could be faulty. Hence the sinker bed usually is a steel bar integrally formed at a length substantially same as the needle bed. One side of the sinker bed corresponding to the sinker control portion has to be formed with a very smooth surface. Precise fabrication is required that makes the resulting product very expensive.

SUMMARY OF THE INVENTION

The primary object of the present invention is to solve the problem of the conventional flat knitting machine equipped with a sinker bed that is costly to fabricate.

To achieve the foregoing object the present invention provides a needle bed structure for flat knitting machines that is located at two sides of a needle bed gap. It includes a plurality of parallel needle plates, a plurality of knitting needles and sinkers located between the needle plates, and a sinker control portion movable in parallel with the arranged direction of the sinkers. The sinker control portion includes a switching portion to perform a switching movement according to the moving direction and at least one control cam driven by the switching portion to push the sinkers to rotate in the direction of the needle bed gap during the switching movement. It also includes at least one needle pressing board on the needle plates to restrict vertical movement of the knitting needles. The switching portion has a magnetic attracting portion corresponding to the needle pressing board to form magnetic attraction therewith. A spacer is provided between the needle plates to prevent horizontal movement of the sinker.

In one embodiment the needle plate has a dovetail groove to hold the needle pressing board.

In one embodiment the spacer and knitting needle are vertically positioned between the needle plate and sinker.

In one embodiment a yarn guiding plate is provided between the knitting needle and sinker.

In one embodiment the sinker has an anchor portion pivotally coupled with a rotation shaft in parallel with the positioned direction of the sinkers.

In one embodiment the needle plate has two openings threaded through by a first holding line and a second holding line.

In one embodiment the spacer includes a first aperture threaded through by the first holding line and a first positioning notch threaded through by the second holding line. The first aperture is a slotted hole. The first position notch has a first retreated recess.

In one embodiment the yarn guiding plate includes a second aperture threaded through by the first holding line and a second positioning notch threaded through by the second holding line. The second aperture is a slotted hole. The second position notch has a second retreated recess.

In one embodiment the yarn guiding plate includes a holding portion to hold the knitting needle.

The needle bed structure of the invention provides features as follow:

1. Providing the needle pressing board above the needle plates and spacers between the needle plates to replace the conventional sinker bed that stabilizes the rotation movement of the sinkers and switches the sinker control portion.

2. By omitting the sinker bed the production cost of the flat knitting machine can be reduced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
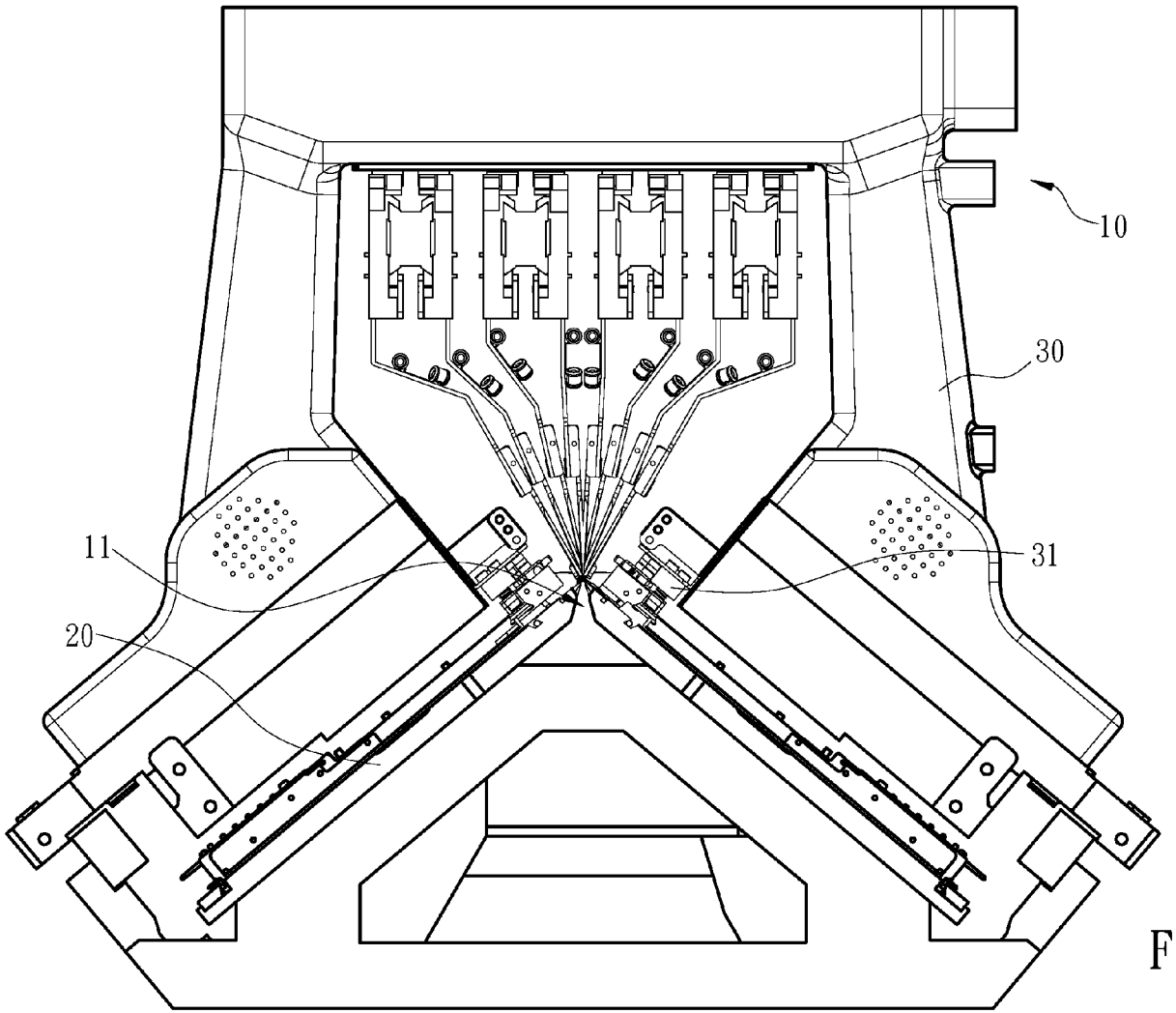
FIG. 1 is a sectional view of a flat knitting machine according to the invention.

The present invention aims to provide a needle bed structure for flat knitting machines. Please referring to FIG. 1, a flat knitting machine 10 adopted the invention includes two needle beds 20 located at two sides of a needle bed gap 11 opposing each other like a mountain shape. Each needle bed 20 has a carrier 30 movable horizontally and reciprocally relative to the needle bed 20. The carrier 30 has a sinker control portion 31 located thereon corresponding to the needle bed 20.

Figure 2:
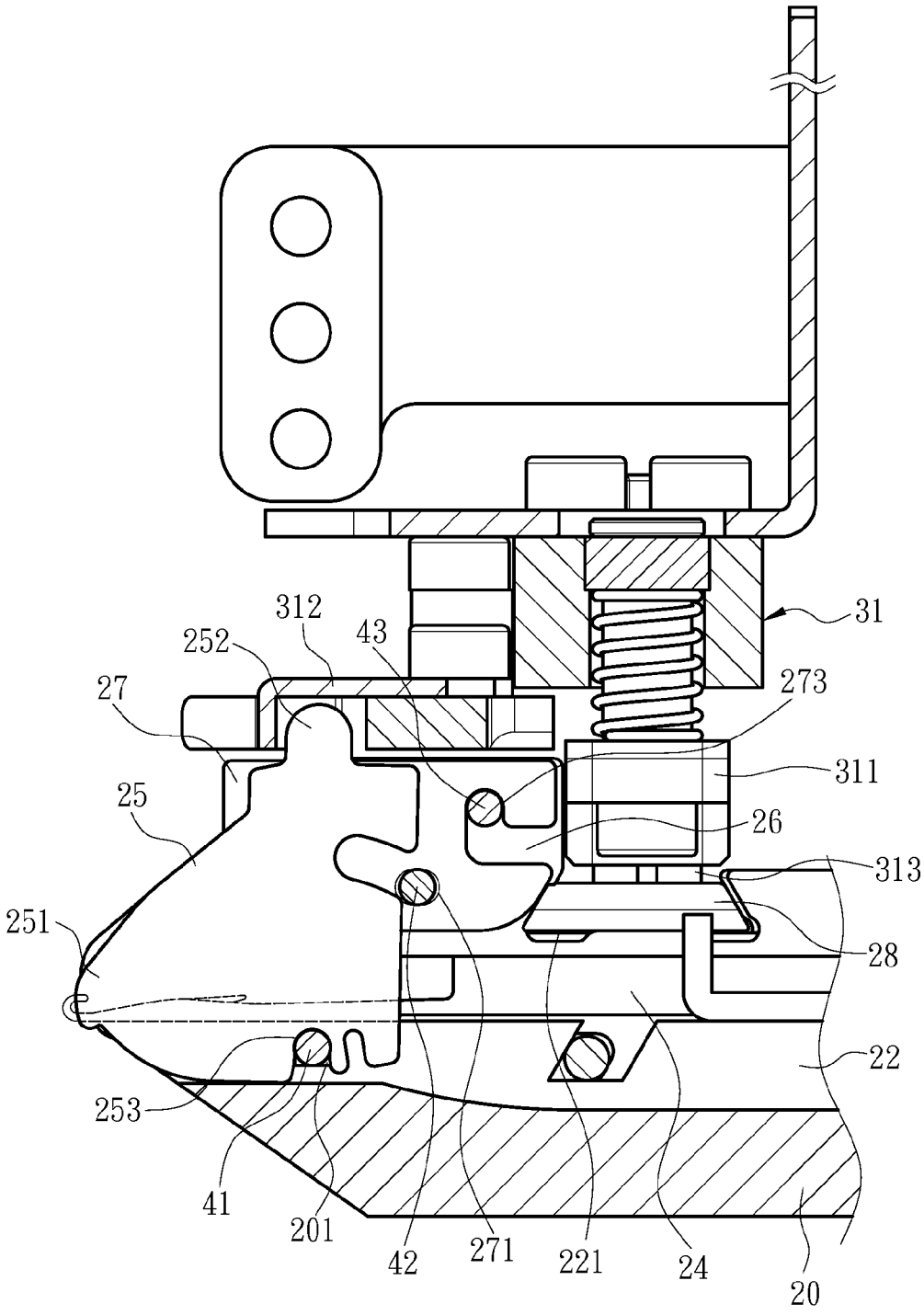
FIG. 2 is a fragmentary sectional view of an embodiment of the needle bed structure for flat knitting machines of the invention.
Figure 3:
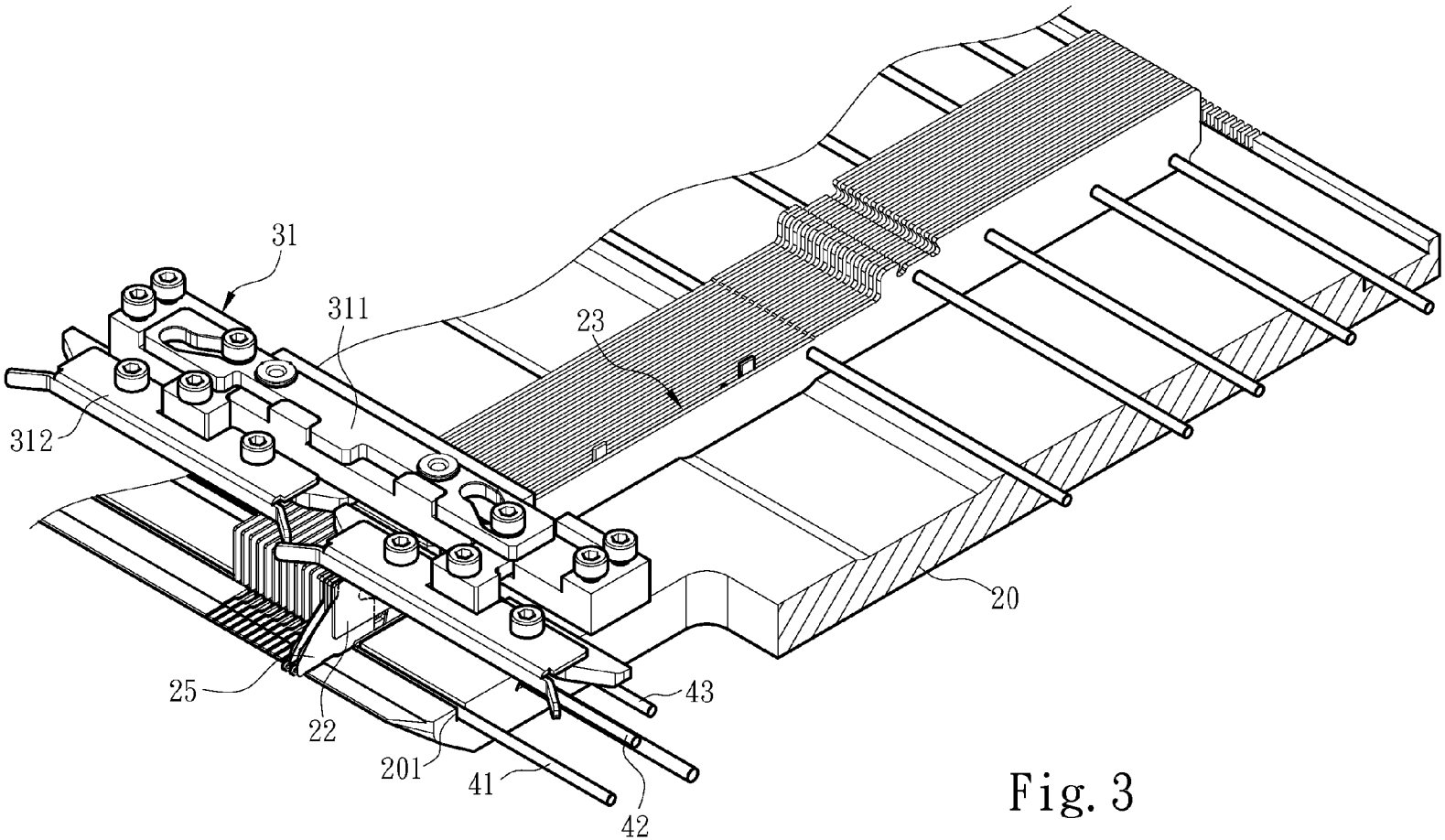
FIG. 3 is a fragmentary perspective view of an embodiment of the needle bed structure for flat knitting machines of the invention.
Figure 4:
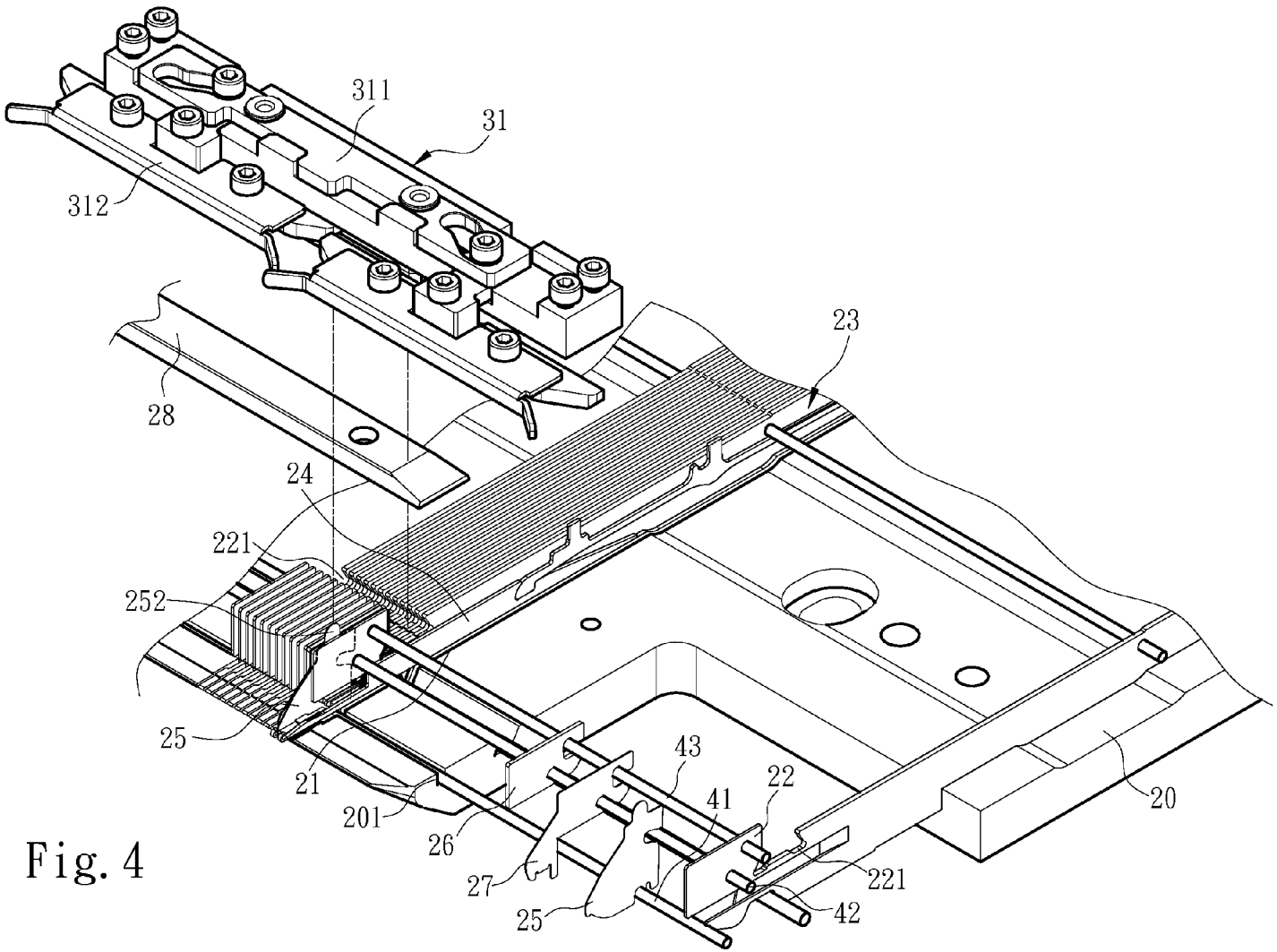
FIG. 4 is a fragmentary exploded view of an embodiment of the needle bed structure for flat knitting machines of the invention.

Please referring to FIGS. 2, 3 and 4, the needle bed 20 on each side has a plurality of parallel ditches 21 each holding a needle plate 22. A needle trough 23 is formed between two neighboring needle plates 22. The needle trough 23 holds therein a knitting needle 24, a sinker 25, a spacer 26 and a yarn guiding plate 27. The knitting needle 24 is movable longitudinally back and forth in the needle trough 23, and can move towards the needle bed gap 11 to pick up a yarn. The sinker 25 includes a downward pressing boss 251, a control boss 252 and an anchor portion 253. The sinker 25 is pivotally coupled on a rotation shaft 41 through the anchor portion 253. The rotation shaft 41 is held in a groove 201 formed on the needle bed 20 parallel with the positioned direction of the sinker 25. The sinker control portion 31 includes a switching portion 311 located on the carrier 30 and at least one control cam 312 driven by the switching portion 311. The control boss 252 is held in the control cam 312. The control cam 312 can be driven by the switching portion 311 and moved towards the needle bed gap 11 to drive the sinkers 25 rotation.

The invention also provides at least one needle pressing board 28 on the needle plates 22 to restrict vertical movement of the knitting needle 24 so that it is retained in the needle trough 23. The needle pressing board 28 may consist of a plurality of segments coupled together. The needle plate 22 has a dovetail groove 221 to securely hold the needle pressing board 28. In this invention the switching portion 311 has a magnetic attracting portion 313 corresponding to the needle pressing board 28 to form magnetic attraction therewith. Because the magnetic attracting portion 313 and needle pressing board 28 attract each other magnetically in normal conditions, when the sinker control portion 31 is driven by the carrier 30 and moved transversely relative to the needle bed 20, the switching portion 311 determines according to the moving direction of the sinker control portion 31 whether the control 312 to push the sinker 25 to rotate towards the needle bed gap 23.

Figure 6:
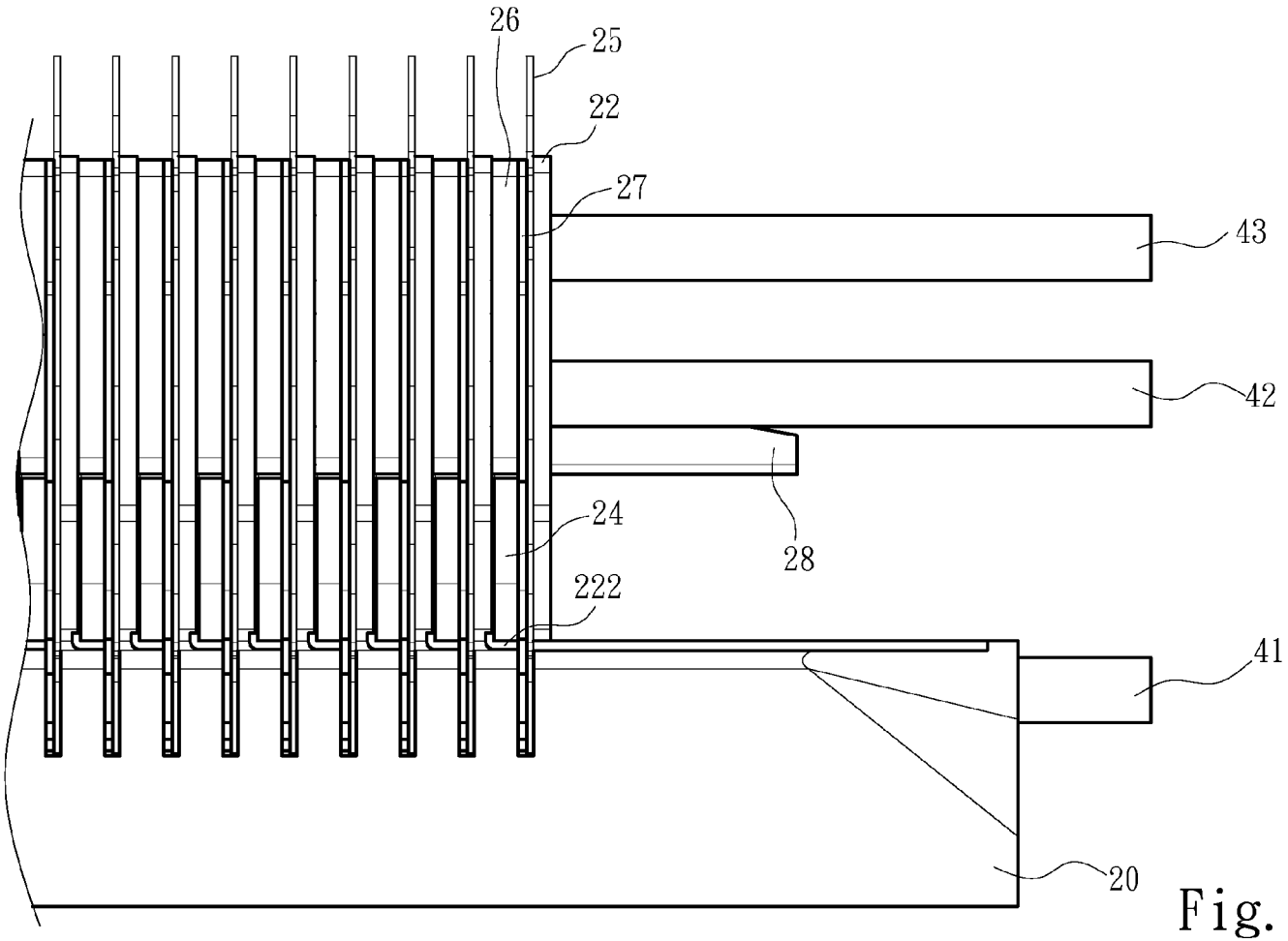
FIG. 6 is a front view of an embodiment of the needle bed structure for flat knitting machines of the invention.
Figure 7:
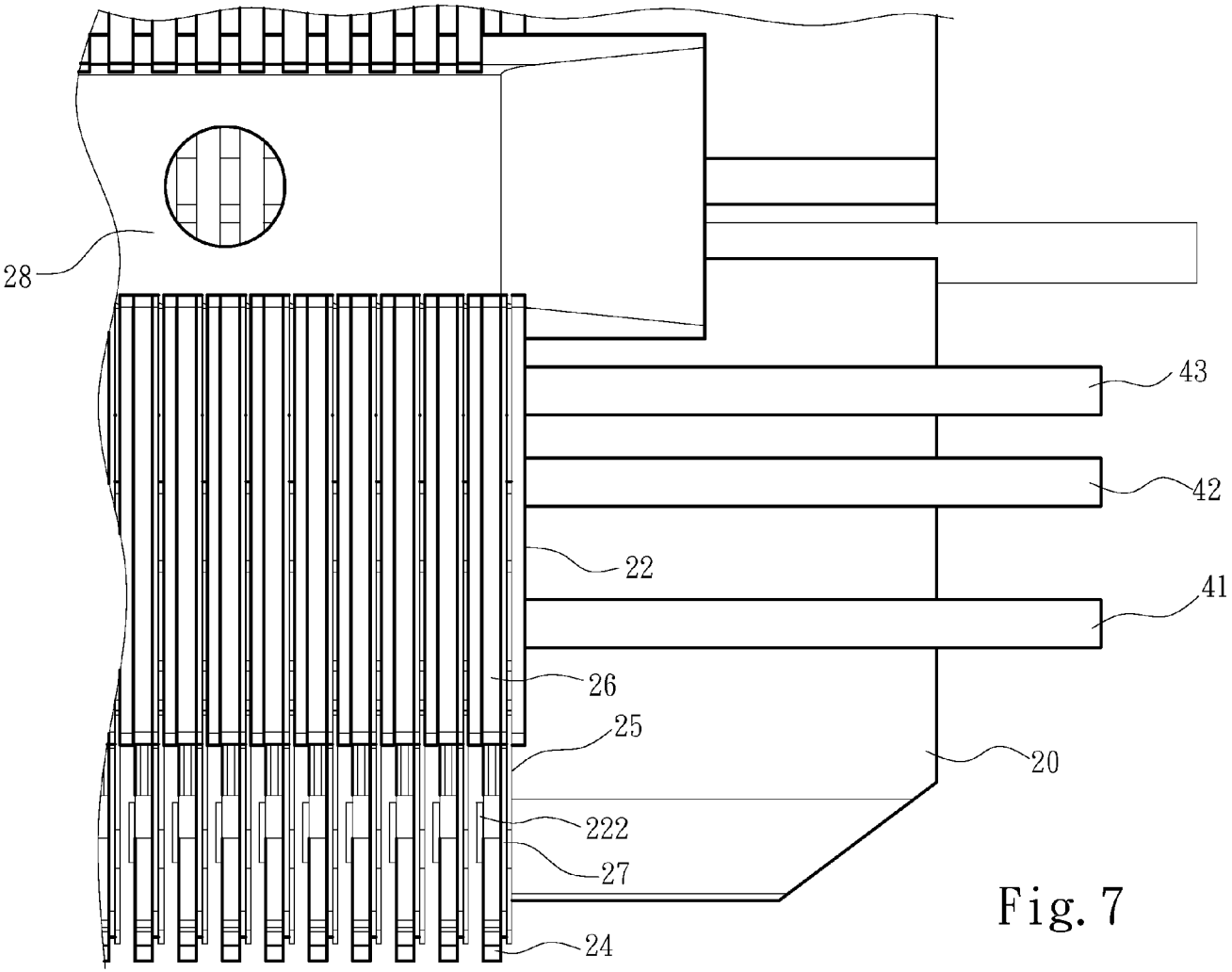
FIG. 7 is a top view of an embodiment of the needle bed structure for flat knitting machines of the invention.

Referring to FIGS. 4, 6 and 7, the needle trough 23 between two needle plates 22 holds a knitting needle 24, a sinker 25, a spacer 26 and a yarn guiding plate 27. The yarn guiding plate 27 has a holding portion 222 to hold the knitting needle 24. The sinker 25 is located between the needle plate 22 and knitting needle 24. The yarn guiding plate 27 is located between the sicker 25 and knitting needle 24. The sinker 25 and yarn guiding plate 27 are located higher than the knitting needle 24. The spacer 26 is located between the yarn guiding plate 27 and needle plate 22 to prevent horizontal movement of the sinker 25 when it rotates towards the needle bed gap 11. The spacer 26 is formed at a thickness same as the knitting needle 24, and both are vertically positioned next to each other. Thereby the upper portion of the sinker 25 can move only between the spacer 26 and needle plate 22 to form steady rotation thereof.

Figure 5:
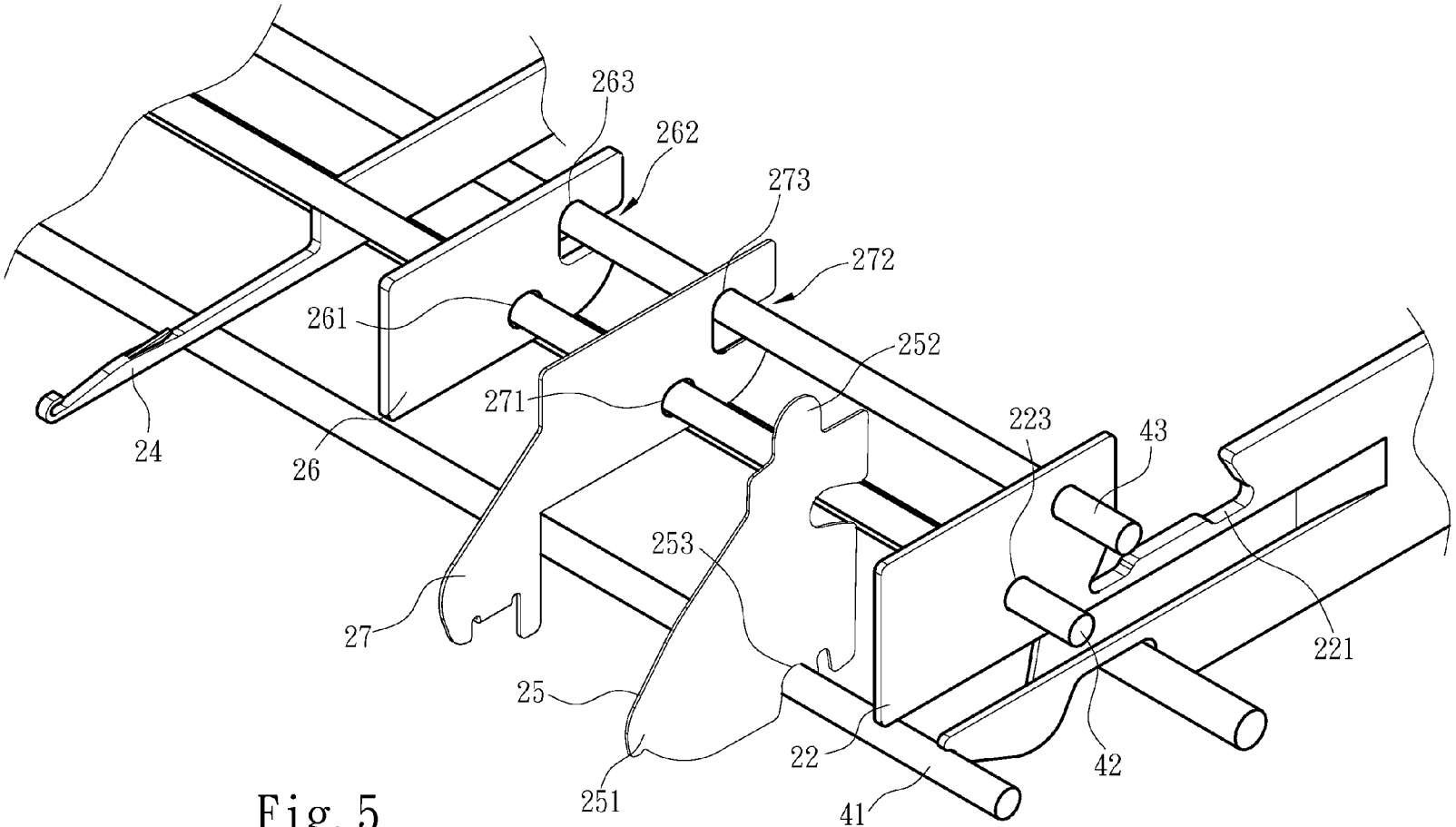
FIG. 5 is a fragmentary enlarged view of an embodiment of the needle bed structure for flat knitting machines of the invention.

The needle plate 22 has two openings 223 threaded through respectively by a first holding line 42 and a second holding line 43 as shown in FIGS. 4 and 5 so that each needle plate 22 can be held securely in a serial string and fixedly positioned on the needle bed 20. In order to keep the spacer 26 and yarn guiding plate 27 in each needle trough 23 at desired positions and to maintain steady movements of the knitting needle 24 and sinker 25 during knitting operation of the flat knitting machine 10, the spacer 26 and yarn guiding plate 27 have respectively an aperture 261 and 271 threaded through by the first holding line 42, and a holding notch 262 and 272 threaded through by the second holding line 43. The holding notches 262 and 272 have respectively a retreated recess 263 and 273 to hold the second holding line 43. In addition, during assembly of the spacer 26 or yarn guiding plate 27, in order to prevent possible tolerances formed on the apertures 261 and 271 that might cause unsmooth threading of the first holding line 42, the apertures 261 and 271 may be formed in a slotted hole with an allowance vertical or horizontal to the needle trough 23.

As a conclusion, the needle bed structure of the invention provides the needle pressing board on the needle plates and a spacer between the needle plates to replace the sinker bed adopted in the conventional techniques for stabilizing rotation of the sinker and switching of the sinker control portion. The coupling seat to bridge the sinker bed and needle plates can also be dispensed with. Hence production cost of the flat knitting machine can be reduced. It provides a significant improvement over the conventional techniques.

While the preferred embodiment of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A needle bed structure for a flat knitting machine located at two sides of a needle bed gap, the needle bed structure comprising a plurality of needle plates parallel with each other, a plurality of parallel knitting needles and sinkers located between the needle plates, a sinker control portion which is movable in parallel with the arranged direction of the sinkers and includes a switching portion to perform a switching movement according to the moving direction, and at least one control cam driven by the switching portion to push the sinkers to rotate towards the needle bed gap during the switching movement; the needle bed structure being characterized in that the needle plates hold at least one needle pressing board thereon to restrict vertical movement of the knitting needles, the switching portion including a magnetic attracting portion corresponding to the needle pressing board to form magnetic attraction therewith, the needle plates being interposed by a spacer to restrict horizontal movement of the sinkers.

2. The needle bed structure of claim 1, wherein the needle plate includes a dovetail groove to hold the needle pressing board.

3. The needle bed structure of claim 1, wherein the needle pressing board includes a plurality of segments coupled together.

4. The needle bed structure of claim 1, wherein the spacer and the knitting needles are vertically positioned between the needle plates and the sinkers.

5. The needle bed structure of claim 1, wherein the knitting needles and the sinkers are interposed by a yarn guiding plate.

6. The needle bed structure of claim 1, wherein the sinker includes an anchor portion which is pivotally coupled on a rotation shaft in parallel with the arranged direction of the sinker.

7. The needle bed structure of claim 1, wherein the needle plate includes two openings threaded through respectively by a first holding line and a second holding line.

8. The needle bed structure of claim 7, wherein the spacer includes a first aperture threaded through by the first holding line and a first positioning notch threaded through by the second holding line.

9. The needle bed structure of claim 8, wherein the first aperture is a slotted hole.

10. The needle bed structure of claim 8, wherein the first positioning notch includes a first retreated recess.

11. The needle bed structure of claim 7, wherein the knitting needle and the sinker are interposed by a yarn guiding plate.

12. The needle bed structure of claim 11, wherein the yarn guiding plate includes a second aperture threaded through by the first holding line and a second positioning notch threaded through by the second holding line.

13. The needle bed structure of claim 12 wherein the second aperture is a slotted hole.

14. The needle bed structure of claim 12, wherein the second positioning notch includes a second retreated recess.

15. The needle bed structure of claim 1, wherein the yarn guiding plate includes a holding portion to hold the knitting needle.

* * * * *